US010215534B1

(12) United States Patent
Choiniere

(10) Patent No.: US 10,215,534 B1
(45) Date of Patent: Feb. 26, 2019

(54) DIGITAL LIGHT PROCESSING GUIDANCE SYSTEM

(71) Applicant: BAE SYSTEMS Information and Electronic Systems Integration Inc., Nashua, NH (US)

(72) Inventor: Michael J. Choiniere, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 6 days.

(21) Appl. No.: 15/677,157

(22) Filed: Aug. 15, 2017

(51) Int. Cl.
*F41G 7/00* (2006.01)
*F41G 7/26* (2006.01)
*F41G 3/06* (2006.01)

(52) U.S. Cl.
CPC ..... *F41G 7/263* (2013.01); *F41G 3/06* (2013.01)

(58) Field of Classification Search
CPC ..... F41G 7/26; F41G 7/263; F41G 7/266
See application file for complete search history.

(56) References Cited

U.S. PATENT DOCUMENTS 3,995,792 A * 12/1976 Otto ..... F41G 7/30 244/3.13
4,003,659 A * 1/1977 Conard ..... F41G 7/30 244/3.11
4,096,380 A * 6/1978 Eichweber ..... F41G 7/008 244/3.13
5,647,559 A * 7/1997 Romer ..... F41G 7/305 244/3.13
7,583,364 B1 * 9/2009 Mayor ..... G01N 21/538 356/4.01

* cited by examiner

*Primary Examiner* — J. Woodrow Eldred
(74) *Attorney, Agent, or Firm* — Davis & Bujold, PLLC

(57) ABSTRACT

The system and method for a digital light processing (DLP) guidance system having a digital light processing (DLP) mirror array at the laser source. A receiver tracks location of the air-borne object using a retro reflector on a pulse-to-pulse basis. The DLP mirror array tracks the air-borne object with a non-scanning beam and immediately provides a correction update to the controller using a pulse repetition interval (PRI) varying code. The system can be packaged in a small format, at a lower cost, and with a higher reliability.

19 Claims, 5 Drawing Sheets

DIGITAL LIGHT PROCESSING GUIDANCE SYSTEM

FIELD OF THE DISCLOSURE

The present disclosure relates to precision guidance and more particularly to using digital light processing (DLP) in a precision guidance system.

BACKGROUND OF THE DISCLOSURE

There are a number of guidance systems that aid in the accurate delivery of an air-borne device to its target. Certain airborne devices, such as drones, can carry extensive and expensive hardware and software to allow the delivery and return of the drone. These devices tend to leverage global positioning system (GPS) information for location, routing and accurate delivery. Other air-borne devices such as missiles, rockets and other precision guided munitions tend to travel at high speeds and have weight, space and cost constraints. Such devices have particular characteristics for accuracy and proper deployment. These may also operate in hostile environments such as GPS-denied areas and be subject to jamming. Despite the adversity, it is desired to have the air-borne device accurately arrive at the target destination.

Some conventional guidance systems comprise beam riders. These beam rider systems rely on a scanning laser to generate a digital pattern in which the air-borne device, such as a precision guided munition, decodes the pattern and then determines its location within the pattern. It can then use that information to aid in reaching the target destination. These scanners tend to have moving parts and tend to be costly. Additionally, these conventional systems consume bandwidth due to the need to scan, thereby increasing latency and reducing bandwidth.

Wherefore it is an object of the present disclosure to overcome the above-mentioned shortcomings and drawbacks associated with the conventional guidance systems. These aspects of the disclosure are not meant to be exclusive and other features, aspects, and advantages of the present disclosure will be readily apparent to those of ordinary skill in the art when read in conjunction with the following description and accompanying drawings.

SUMMARY OF THE DISCLOSURE

One aspect of the present disclosure is a digital light processing guided system comprising a laser source configured to generate a plurality of pulsed signals comprising pulse repetition interval information; a controller configured to guide a munition using the plurality of pulsed signals comprising pulse repetition interval information; a retro reflector located on the munition; and a laser range finder comprising a digital light processing mirror array configured to detect the plurality of pulsed signals returned by the retroreflector.

One embodiment of the digital light processing guided system is wherein the laser source is a 1.57 μm micro laser. In some cases a portion of the plurality of pulsed signals indicate elevation and azimuth information. In certain embodiments, the azimuth and elevation information are coded separately.

Another embodiment of the digital light processing guided system is wherein the laser range finder comprises an avalanche photodiode.

Another aspect of the present disclosure is a digital light processing method of guiding a munition comprising generating, with a laser source, a plurality of pulsed signals comprising pulse repetition interval information; guiding a munition, with a controller using pulse repetition interval information in the plurality of pulsed signals; and detecting, with a laser range finder comprising a digital light processing mirror array, the plurality of pulsed signals returned by a retroreflector located on the munition.

One embodiment of the digital light processing method is wherein the laser source is a 1.57 μm micro laser. In some cases a portion of the plurality of pulsed signals indicate elevation and azimuth information. In certain embodiments, the azimuth and elevation information are coded separately.

Another embodiment of the digital light processing method is wherein the laser range finder comprises an avalanche photodiode.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

According to some embodiments, the present system provides the ability to track in-coming threats in a small form factor. By using a digital light processing (DLP) mirror array at the laser source, the control receiver tracks location of the air-borne device such as a munition using a retro reflector on a pulse-to-pulse basis. The DLP tracks the munition with a non-scanning beam and immediately provides a correction update to the airborne device using a pulse repetition interval (PRI) varying code.

The seeker and beam riding laser architecture can be packaged in a small format, at a lower cost, and with a higher reliability. There are no moving parts other than the micro mirrors in the array. The cost of the DLP scanner is reduced considerably and in one example can be packaged in about 2 $in^3$.

Figure 1:
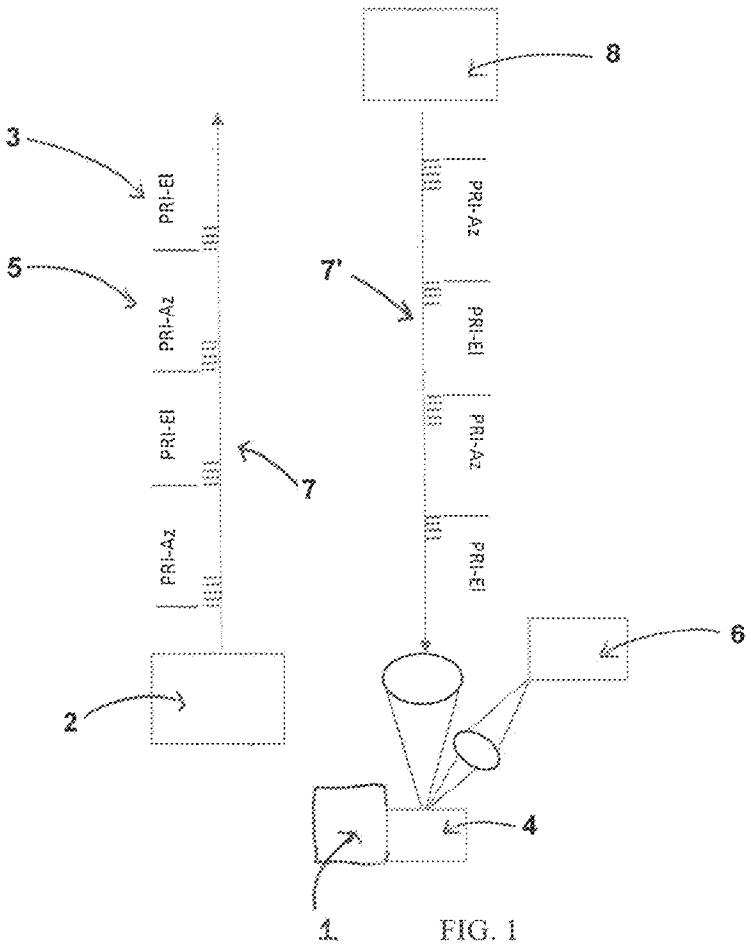
FIG. 1 shows one embodiment of the digital light processing guided system of the present disclosure.

Referring to FIG. 1, one embodiment of the digital light processing guided system of the present disclosure is shown. In one example the laser source 2 and a control receiver unit 1 are co-located in close proximity to each other and can be in the same housing. In a further example the laser source and control receiver unit share processing and memory resources. More specifically, a laser source 2 is used to generate a pulsed signal having pulse repetition interval (PRI) information. In certain embodiments, the laser is a 1.57 μm micro laser, or the like. In one case, certain pulses indicate elevation (El) information 3 and other pulses indicate azimuth (Az) information 5. In certain embodiments, the Az and El are coded separately. In one example the El and Az information represents correction information to help guide the air-borne device to the target. The air-borne device 8 has an air-borne receiver unit that processes the correction information and applies the adjustment to its flight path instructions. The Az and El correction information in one embodiment is based upon reflected signals from the air-borne device.

The encoded laser signal 7 from the laser 2 is directed to the air-borne device 8, wherein the air-borne device 8 includes a retro reflector (not shown) that reflects a portion of the inbound encoded laser signal 7 and provides a reflected encoded laser signal 7'. The reflected encoded laser signal 7' is picked up by the control receiver 1. The control receiver 1 receives the reflected laser signal 7' and it is processed by a digital laser processing (DLP) unit 4. While not shown, in one embodiment further optical elements are on the front end of the control receiver 1 to focus the reflected laser signal 7'. The DLP unit 4 in one example has micromirrors coupled to a semiconductor and forming a digital micromirror device (DMD) that processes the digital optical signals thru the DLP spatial filter represented by FIG. 2. The spatial filter generates a unique digital pattern that represents the retro-reflector's location within the field of view of the control receiver 1.

Still referring to FIG. 1, the control receiver comprises one or more processors that access instructions, such as firmware and software, resident in memory to process the digital signals from the DLP unit 4. The control receiver 1 in one example also includes a laser range finder (LRF) 6 by measuring the time of flight of the outgoing pulse in the return.

By using a polarized light source and a polarizer on the air-borne device (not shown) also referred to as a seeker that receives a portion of the reflected signal 7' and is able to provide a vertical reference of air-borne device 8. In some cases, the air-borne receiver uses two PIN detectors, one polarized (orientation signal) and one non-polarized (reference) to establish the vertical reference. In one example the PIN detectors are InGaAs avalanche photodiodes (APD), or the like.

The air-borne device 8 includes an air-borne receiver that converts the received pulsed signal into a digital signal that aids in guiding the air-borne device to the target. One example is a rocket or rocket propelled grenade where the guidance system tracks the path of the rocket and provides correction information to the rocket in the pulsed signal that is processed on-board the rocket.

Figure 2:
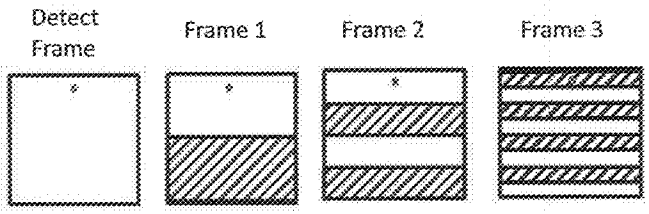
FIG. 2 is a representation of the use of a digital light processing mirror array to determine the location of a munition according to the principles of the present disclosure.

Referring to FIG. 2, a representation of the use of digital light processing using a mirror array or digital micromirror array to guide a munition according to the principles of the present disclosure is shown. More particularly, with as little as four frames (e.g., a detect frame, frame 1, frame 2 and frame 3), the position of the returned signal from the retro reflector of the munition can be determined to within at least +/−6% resolution. In some cases, more precise resolution may be needed and the system can use more frames, higher processing speeds and the like. The series of frames digitally encodes the retro-reflectors location relative to the centerline of the beam, providing the information guidance control needs to complete the guidance loop. According to the principles of the present disclosure, the actual offset flight error is defined by reducing the flight zone by time, as seen, for example, in FIG. 3.

Figure 3:
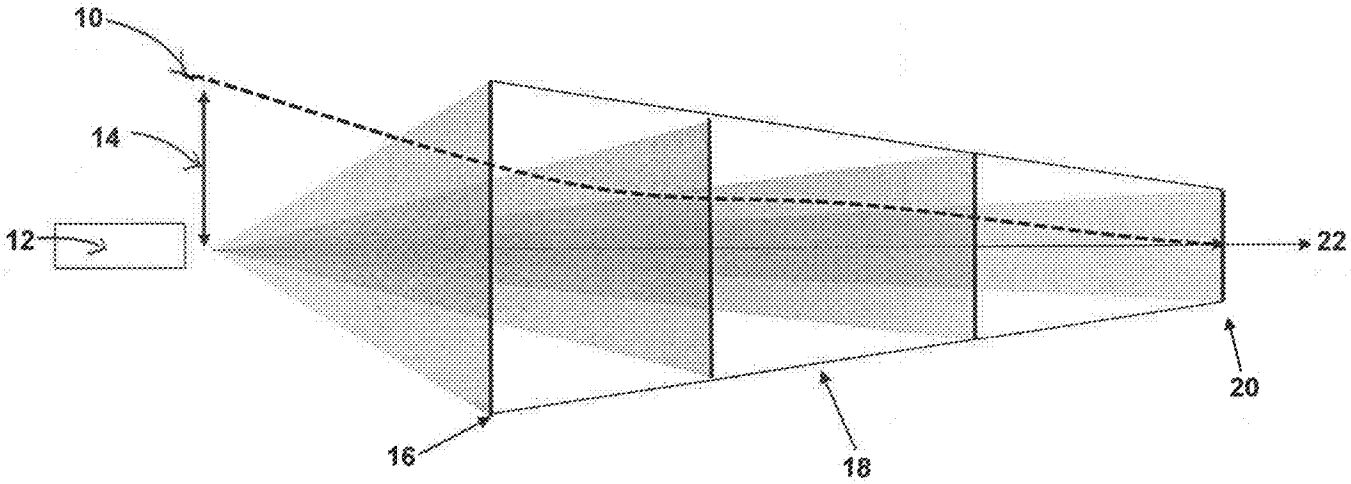
FIG. 3 shows one embodiment of the system of the present disclosure showing corrections to flight path according to the principles of the present disclosure.

Referring to FIG. 3, one embodiment of the system of the present disclosure showing corrections to flight path according to the principles of the present disclosure is shown. More specifically, a launch site 10 is shown at some offset distance 14 from the guidance system 12. The air-borne device is launched from the launch site such as a UAV, aircraft, or other platform. Launching the air-borne device is done at some distance from the guidance system 12, in part, to avoid return fire on the guidance system—negating the system. The guidance system 12 increases its field of view to capture the air-borne device and provides guidance feedback to drive it to the centerline of the beam. The feedback contains up/down, left/right commands to the air-borne device, while progress is monitored by the guidance controller. The guidance system tracks the air-borne device and may start the detection with a wide beam 16 and provide corrections to the air-borne device as it travels toward the target 22. In the depicted embodiment, the guidance system continues to communicate intermittently with the air-borne device with adjustments and course corrections. The beam is brought in narrower for a finer resolution and the accuracy also improves.

First, a wide area 16 is used to ensure capture for the offset control from the launch point. Next, a reduced area 18 ensures a correct flight path. A tighter area 20 ensures a hit on the target 22. There can be any number of reduced areas while the air-borne device travels to the target depending upon factors such as speed, distance, and communications capabilities. In some cases, the flight controller knows the initial flight path, but correction is typically still needed for precision targeting. The system provides proper reduction to the error zones using known time and range information from the built in LRF on the control device. In FIG. 3, the same +/−6% resolution is shown, but with increased accuracy. In some cases, the beginning accuracy is about 10 m and the ending accuracy is amount 1 m. The DLP mirror detection is an improvement over conventional amplitude based detection because turbulence from a spinning munition interferes with amplitude based detection. Here, the DLP mirror based detection is based on time.

Figure 4:
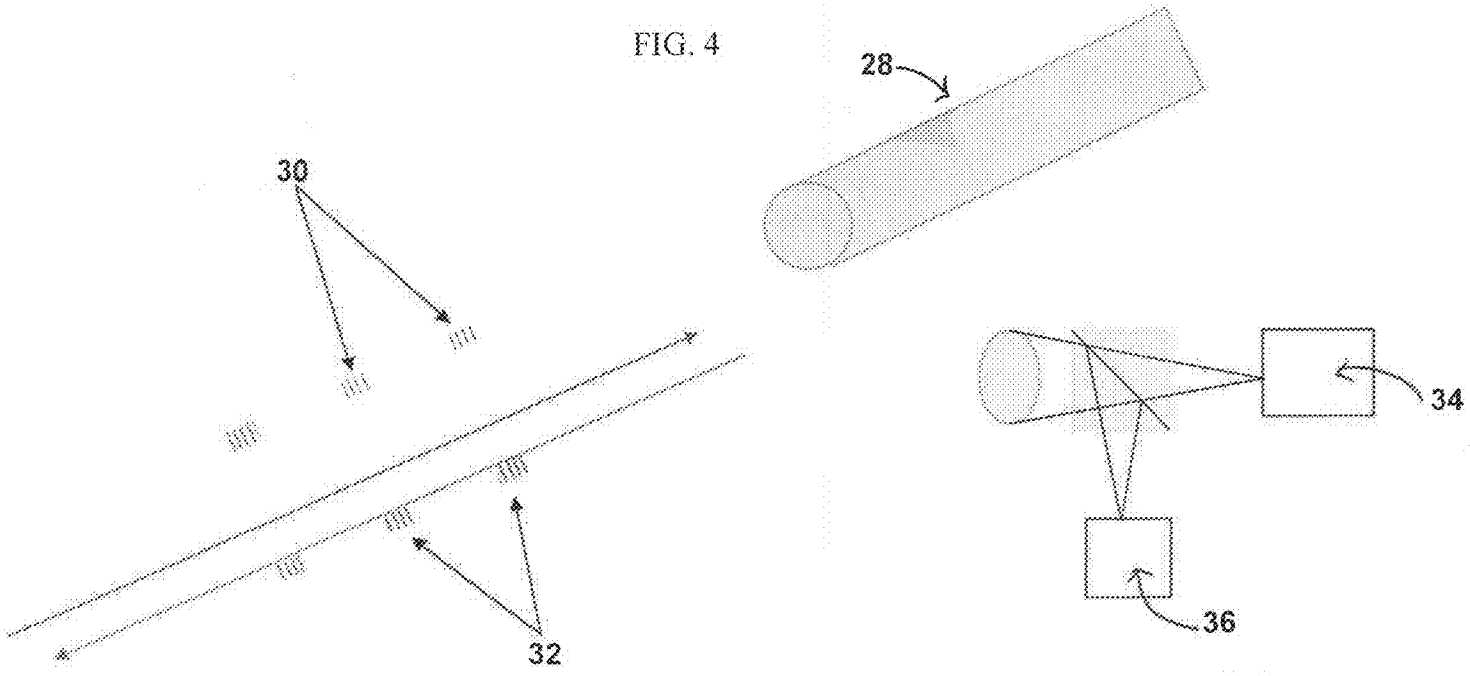
FIG. 4 shows one embodiment of the system of the present disclosure using pulse repetition interval (PRI) guidance corrections according to the principles of the present disclosure.
Figure 5:
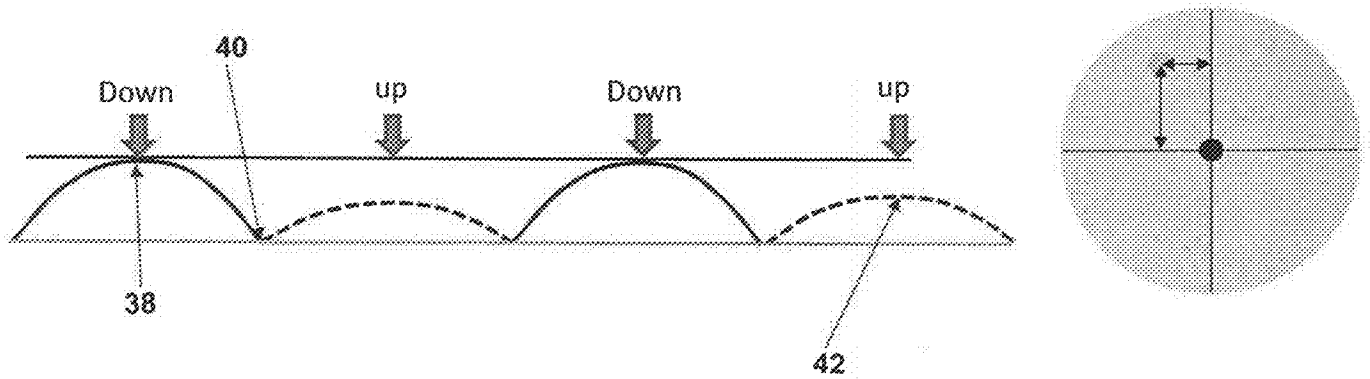
FIG. 5 shows one embodiment of the digital light processing guidance system with up and down finding feature of the present disclosure.

Referring to FIG. 4, one embodiment of the system of the present disclosure using pulse repetition interval (PRI) guidance corrections according to the principles of the present disclosure is shown. More particularly, PRI control 30 is used and a retro return grouping 32 is reflected back from an air-borne device such as a rocket propelled grenade (RPG) 28, or the like. Modulation of the signals is provided in some cases with a full amplitude detector 34 and a modulated polarized detector 36 on the air-borne device. In certain embodiments, modulation of the signals is induced by ½ field of view (FOV) offset and a polarizer, as shown in FIG. 5. Detector 34 generates a reference amplitude to compare to the polarized signal from detector 36. In one embodiment, detector 36 is also biased away from the detector center line by ~30° resulting in a reduced amplitude looking away from the laser and a full amplitude when looking at the laser. The asymmetry identifies the up or down direction using the full amplitude detector 34 as a reference channel. When the weapon knows its position by Azimuth and Elevation PRI, the up/down/vertical reference gives the weapon needed orientation to complete its navigation.

Referring to FIG. 5, one embodiment of the digital light processing guidance system with an up down finding feature of the present disclosure is shown. More specifically, the peak 38 represents alignment with a polarized laser and looking toward the laser (on the ground) to provide a vertical reference. At periodic spacing, as the munition spins, the signal is null 40 due to cross polarization. Offset optics 42 look away from the laser source and that results in no signal skyward.

The system bandwidth of the present disclosure in one embodiment approaches 300 Hz. In certain embodiments, the system is from about 20 Hz to about 30 Hz. The seeker utilizes a pair of PIN detectors for measuring time interval pulses and amplitude as the weapon is spinning. The spinning induces a modulation on detector 36. Detector 34 generates a received reference signal level that compensates for atmospherics amplitude variation due to scintillation (e.g., 10 to 500%). The shallow response from the offset FOV is pointing away from the ground where the laser is located thus determining upward direction.

In one embodiment of the system, a 3000 RPM spin rate results in a 50 Hz spin rate or a 18000 degrees per second rate for the spinning munition. At 3 KHz, that is a 6.0 degree rotation per pulse. With a 1 second launch profile, the system establishes up and down reference to the pulse code and a vertical reference is tracked as part of the PRI variability. With four pulse groupings, the four pulses measure a 24 degree arc swing/coupled with low cost inertia measurement unit (IMU) to establish PRI tracking and control either with an Az/El or LOS vector in <0.05 seconds. Variability in PRI provides commands, and with 5 groupings the vectors are determined assuming a 100 Hz update rate for each vector provides 20 data points, sufficient to determine orientation.

Figure 6:
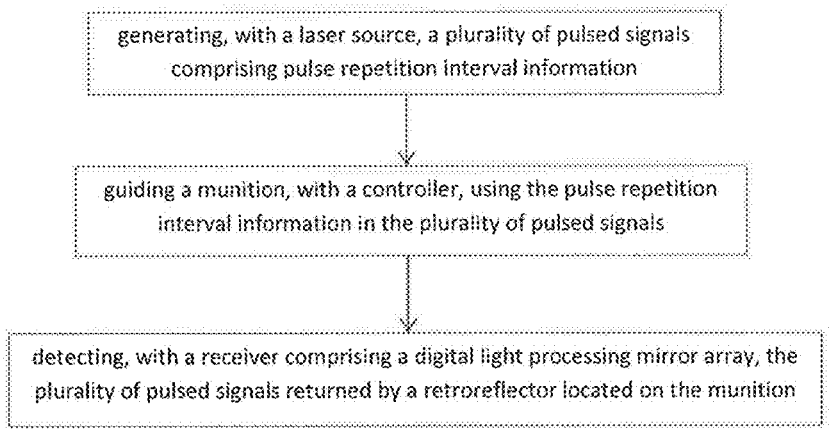
FIG. 6 depicts a process flow of the guidance system according to one embodiment.

FIG. 6 provides a process flow for the present disclosure. In certain embodiments, a processor using digital code determines spatial position. The processor then sends guidance commands to steer the air-borne device to the beam centerline. The process is repeated until the air-borne object reaches the desired target. In one embodiment, a plurality of pulsed signals are generated using a laser source. In some cases, these pulsed signals include pulse repetition interval (PRI) information. In some cases the PRI information is Az and El information. The air-borne object has an airborne receiver unit that uses the pulse repetition information in the pulsed signals sent by the laser source to guide the air-borne object. A separate control receiver comprising a digital light processing mirror array detects pulsed signals that have been reflected back from the air-borne object to determine spatial position of the air-borne object.

It will be appreciated from the above that the invention may be implemented, in part, as computer software, which may be supplied on a storage medium or via a transmission medium such as a local-area network or a wide-area network, such as the Internet. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A guidance system comprising:

a laser source configured to generate a plurality of pulsed signals comprising pulse repetition interval information, wherein the plurality of pulsed signals are transmitted in a pattern;

an air-borne device comprising a retroreflector and a laser range finder, the laser range finder comprising a first PIN detector and a second PIN detector, where the first PIN detector is polarized and the second PIN detector is non-polarized, wherein the air-borne device receives the plurality of pulsed signals and the retroreflector generates a plurality of reflected pulsed signals;

a control receiver comprising:

a digital light processing mirror array configured to detect the plurality of reflected pulsed signals returned by the retroreflector; and an air-borne controller configured to guide the air-borne device using the plurality of pulsed signals comprising the pulse repetition interval information.

2. The guidance system of claim 1, wherein the laser source is a 1.57 μm micro laser.

3. The guidance system of claim 1, wherein a portion of the plurality of pulsed signals indicate elevation and azimuth information for the air-borne device.

4. The guidance system of claim 3, wherein the azimuth and elevation information are coded separately.

5. The guidance system of claim 1, wherein the laser range finder comprises two or more avalanche photodiodes.

6. The guidance system of claim 5, wherein the two or more avalanche photodiodes are InGaAs avalanche photodiodes.

7. A digital light processing method of guiding an air-borne device, comprising:

generating, with a laser source, a plurality of pulsed signals comprising pulse repetition interval information, wherein the pulse repetition interval information is transmitted in a pattern;

guiding the air-borne device, with a controller on the air-borne device using the pulse repetition interval information in the plurality of pulsed signals and vertical reference information from a laser range finder located on the air-borne device;

detecting, with a control receiver comprising a digital light processing mirror array, the plurality of pulsed signals returned by a retroreflector located on the munition using a plurality of frames, wherein the plurality of pulsed signals returned by a retroreflector comprises azimuth and elevation information of the air-borne device; and updating the pattern of the plurality of pulsed signals to include the azimuth and elevation information of the air-borne device, thereby guiding the air-borne device.

8. The digital light processing method of claim 7, wherein the laser source is a 1.57 μm micro laser.

9. The digital light processing method of claim 7, wherein the azimuth and elevation information are coded separately.

10. The digital light processing method of claim 7, wherein the laser range finder comprises two or more avalanche photodiodes.

11. The guidance system of claim 1, wherein the system has a resolution of about ±6 degrees.

12. The guidance system of claim 1, wherein the system has an accuracy of less than 10 m.

13. The digital light processing method of claim 10, wherein the laser range one of the two or more avalanche photodiodes is polarized and another of the two or more photodiodes is non-polarized to establish a vertical reference.

14. The digital light processing method of claim 7, wherein the plurality of frames is at least four frames and results in a resolution of about ±6 degrees.

15. The digital light processing method of claim 7, wherein the detection of the air-borne device by the receiver has an accuracy of less than 10 m.

16. An air-borne device guidance system comprising:

a laser source configured to generate a plurality of pulsed signals using pulse repetition interval information comprising azimuth and elevation information for the air-borne device;

a control receiver comprising:

a digital light processing mirror array configured to detect a plurality of reflected pulsed signals returned by a retroreflector located on the air-borne device; and a processor for processing the azimuth and elevation information detected by the control receiver;

a common housing for the control receiver and the laser source;

a laser range finder located on the air-borne device comprising a first PIN detector and a second PIN detector, where the first PIN detector is polarized and the second PIN detector is non-polarized to establish a vertical reference for the air-borne device; and an air-borne controller configured to guide the air-borne device using the azimuth, elevation, and vertical reference information.

17. The air-borne device guidance system of claim 16, wherein the processing of the azimuth and elevation information for the air-borne device detected by the digital light processing mirror array utilizes a plurality of frames.

18. The air-borne device guidance system of claim 17, wherein the plurality of frames is at least four frames and results in a resolution of about ±6 degrees.

19. The air-borne device guidance system of claim 16, wherein the detection of the air-borne device by the receiver has an accuracy of less than 10 m.

* * * * *